United States Patent [19]

Tatsumi et al.

[11] 3,980,049

[45] Sept. 14, 1976

[54] DEVELOPING UNIT FOR ELECTROPHOTOGRAPHY

[75] Inventors: Susumu Tatsumi, Kawasaki; Seiichi Miyakawa, Nagareyama, both of Japan

[73] Assignee: Ricoh Co., Ltd., Japan

[22] Filed: Jan. 28, 1976

[21] Appl. No.: 653,155

[30] Foreign Application Priority Data

Jan. 28, 1975 Japan ..... 50-12014

[52] U.S. Cl. ..... 118/637; 355/10; 118/DIG. 23

[51] Int. Cl.[2] ..... G03G 13/10

[58] Field of Search ..... 118/637, DIG. 23; 355/3 DD, 10; 96/1 SD; 427/14, 15

[56] References Cited

UNITED STATES PATENTS

| | | | |
|---|---|---|---|
| 3,752,119 | 8/1973 | Matkan | 355/10 |
| 3,782,818 | 1/1974 | Smith | 118/DIG. 23 |
| 3,807,997 | 4/1974 | Cade et al. | 118/637 |
| 3,892,481 | 7/1975 | Schaefer et al. | 118/DIG. 23 |
| 3,932,034 | 1/1976 | Takahashi | 118/637 |

*Primary Examiner*—Henry S. Jaudon
*Attorney, Agent, or Firm*—McGlew and Tuttle

[57] ABSTRACT

A developing unit for use with electrophotographic copying apparatus which uses a developing electrode for preventing unfavorable results such as edge effect, missing of fine lines, etc. A pair of conductor plates are maintained one behind the other and face a photosensitive surface of a photoreceptor carrying an electrostatic latent image, the conductor plate remote from the surface being connected to the ground directly or through a constant voltage source, with respective portions of the developer used filling the spaces between the plates and photoreceptor which may constitute a voltage divider, thus maintaining the function of the divider irrespective of variations in the resistances of such filling fractions of the developer with aging, environmental factors, etc. thus obtained potential on the other conductor plate provides a stable index of the potential to be applied to the developing electrode. The latter conductor plate itself may be consistent with the developing electrode.

9 Claims, 9 Drawing Figures

DEVELOPING UNIT FOR ELECTROPHOTOGRAPHY

BACKGROUND OF THE INVENTION

The invention relates to a developing unit including a developing electrode and in which a toner is brought into contact with the surface of a photosensitive member carrying an electrostatic latent image to provide developing thereof, and more particularly to a self-biased developing unit for electrophotography which automatically controls a bias potential to be applied to the developing electrode and which is of a suitable magnitude to provide a copy free from background smearing.

It is known that a developing technique; such as a cascade process which employs no developing electrode or involved application of a bias; unfavorably produces an edge effect on a copy having a high proportion of image areas such as photographs, even though it may be successfully employed for a copy having a reduced proportion of image areas, such as letterprints. A magnetic brush developing technique which employs a dry developer, or a developing technique which employs a developing electrode together with a wet developer, can be successfully used to provide a satisfactory copy from both originals having a high and a low proportion of image areas, by applying a bias potential to the magnetic brush or the developing electrode which is, by a fixed amount, higher than the background potential of the surface of the photosensitive member. However, this only applies when the exposure is properly chosen, and, if the exposure is improper, there cannot be obtained a satisfactory copy. Since a document being copied frequently has a varying background density or a varying color, it is then necessary to choose a proper exposure for each individual original to be copied in order to provide a copy which is free from background smearing, by using the developing process which employs the above-mentioned fixed bias. The determination of the exposure is made only after a copy is actually produced, so that there may result a waste of unsuccessful copies before a satisfactory copy can be obtained.

To overcome the above disadvantage, there has been proposed a self-biased developing technique, commonly referred to as self auto-bias technique. With this technique, an electric charge on the surface of the photosensitive member, which varies with an original to be copied, is detected to automatically control a suitable bias potential applied to the developing electrode in accordance with the detected magnitude of the charge. The auto-bias technique can be implemented in a relatively complex arrangement which requires an external source and an electrical arithmetic circuit to control and apply an optimum bias potential, thus supplying a forced bias. Though positive in action, it is complex in arrangement and is also expensive. A simple arrangement according to the auto-bias technique is also known in an arrangement which uses a developing electrode of a floating potential type. As shown in FIG. 1, which represents an electrical equivalent circuit, an average surface potential Vs of a latent image on the photosensitive member is divided by a voltage divider comprising a resistance R1, of a developer present between the photosensitive member and the developing electrode, and a resistance R2, existing between the developing electrode and the body of the machine, thereby inducing a potential $V_D$ which is applied to the developing electrode as a bias potential. The relationship between the average surface potential Vs of the latent image and the potential $V_D$ of the developing electrode is depicted in FIG. 2, and can be represented as follows:

$$VD = \frac{R_2}{R_1 + R_2} \times Vs$$

$$\tan\theta = \frac{R_2}{R_1 + R_2} \lessapprox 1$$

By a suitable choice of R1 and R2, there can be produced automatically an adequate potential, for the developing electrode, which depends on the varying potential of the latent image. However, while the described technique provides a satisfactory copy for an original having a high proportion of image areas, it produces a copy with background smearing from a document having a lower proportion of image areas. In addition, an original of a reduced brightness, such as photographs, will result in a generally whitish copy. Finally, degradation in the toner quality by aging or environmental change may cause a change in the resistance R1 presented by the developer, thus making it difficult to maintain a satisfactory copy quality over a prolonged period of use.

SUMMARY OF THE INVENTION

It is an object of the invention to provide a self-biased developing unit which provides a positive action such as afforded by a forced biasing technique, and which is simple in construction such as with a developing electrode of a floating potential type.

It is another object of the invention to provide a self-biased developing unit which provides a satisfactory copy free from background smearing, without requiring an adjustment of the exposure, even when a document being copied has a varying background density or a varying color.

In accordance with the invention, there is provided a self-biased developing unit comprising a first conductor located adjacent to the surface of a photosensitive member which is adapted to carry a latent image, and a second conductor located adjacent to the first conductor and having a fixed potential applied thereto, a developer present between the surface of the photosensitive member and the first conductor and between the first and second conductors being effective to derive from the electric charge of the latent image on the surface of the photosensitive member in conjunction with the fixed potential applied to the second conductor, a bias potential applied to the first conductor and of a magnitude which is adequate to produce a copy free from background smearing.

DETAILED DESCRIPTION OF EMBODIMENTS

Figure 1:
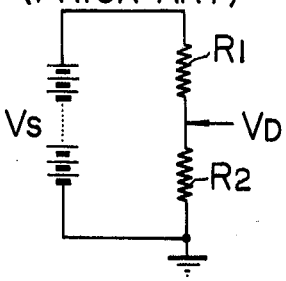
FIG. 1 (PRIOR ART)
FIG. 1 is an electrical equivalent circuit diagram of a self auto-bias unit which employs a conventional developing electrode of a floating potential type.
Figure 2:
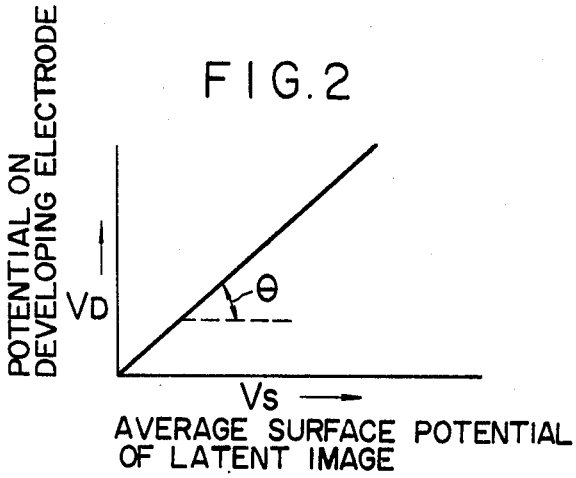
FIG. 2 graphically shows the relationship between the potential applied to the developing electrode and the average surface potential of a latent image.
Figure 3:
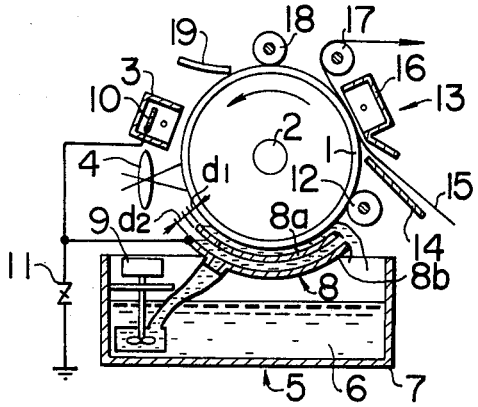
FIG. 3 is a schematic view of an electrophotographic copying machine in which one embodiment of the invention is incorporated.

Referring to FIG. 3, there is shown a photosensitive member 1 in the form of a drum having a photoconductive, insulating layer on the surface thereof. The drum is fixedly mounted on a shaft 2 and is adapted to be rotated in the direction indicated by an arrow at a uniform rate. During the rotation, the drum surface is initially uniformly charged by a corona discharger 3, which may have a suitable polarity depending on the characteristic of the photoconductive, insulating layer disposed on the drum surface. An image of a document being copied is projected through an optical exposure system 4 to the charged surface of the drum, whereby the surface charge is selectively removed to form an electrostatic latent image on the drum surface.

The latent image formed is converted into a visual image by bringing it into contact with a toner in a developing station 5. The station 5 comprises a vessel 7 for containing a supply of developing solution 6, and a pump 9 which supplies the developing solution 6 to a composite developing electrode 8. The composite electrode 8 comprises a first conductor 8*a* located adjacent to the surface of the drum, and a second conductor 8*b* located adjacent to the first conductor 8*a*. The first conductor 8*a* is spaced from the drum surface by a given spacing $d_1$, and the first and second conductors are spaced apart by a spacing $d_2$. The first conductor is electrically insulated, and, in the present embodiment, the second conductor is connected with an electrode plate 10 disposed within the corona discharger 3 and also with one terminal of a varistor 11 the other terminal of which is connected with the ground. In this manner, a discharge current which is derived by the electrode plate 10 is supplied to the second conductor 8*b* at a constant voltage. The source comprising the electrode plate 10 may be replaced by an external source, which, however, should have the same polarity as the corona discharger 3.

A squeeze roller 12 removes or scrapes an excess amount of developing solution from the drum surface, and the developed image carried on the drum surface is brought into overlying relationship with a transfer sheet 15 as it is fed along a guide plate 14, and is transferred onto the latter sheet as a corona discharger 16 produces a discharge of a sufficient strength to attract the toner, which forms the image, to the sheet. The transfer sheet 15 having the image transferred thereto is delivered around a delivery roller 17. On the other hand, any toner remaining on the drum surface is removed by a cleaning roller 18 and a cleaning blade 19.

Figure 4:
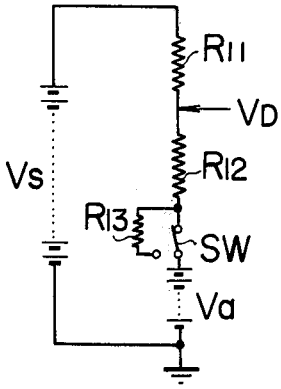
FIG. 4 is a circuit diagram of the electrical equivalent circuit of the self-biased developing unit shown in FIG. 3.

The electrical equivalent circuit of the developing unit is represented in FIG. 4 wherein Vs represents the average surface potential of the electrostatic latent image, R11 the resistance of that fraction of the developer which is present in the space $d_1$ between the drum surface and the first conductor, R12 the resistance of that fraction of the developer which is present in the space $d_2$ between the first and second conductors, $V_D$ the potential of the first conductor which functions as a developing electrode, and Va a fixed potential applied to the second conductor. Accordingly, the following relationship is established:

$$V_D = \frac{R_{12}}{R_{11} + R_{12}}(V_S - V_a) + V_a$$

Figure 5:
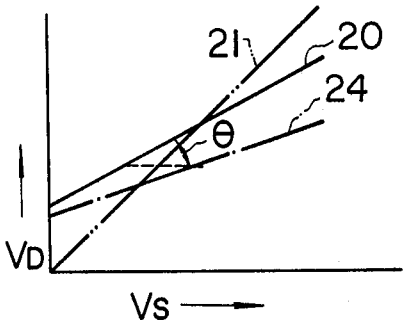
FIG. 5 graphically shows the relationship between the potential applied to the developing electrode and the average surface potential of the latent image.

This is indicated by a solid line curve 20 in FIG. 5, and the angle of inclination Θ of the curve 20 is given by the following expression:

$$\tan \theta = \frac{R_{12}}{R_{11} + R_{12}}$$

In FIG. 5, a phantom line or double dot chain line 21 represents the corresponding relationship which prevails with the conventional developing electrode of floating potential type.

Since the potential $V_D$ applied to the first conductor 8A varies with the average surface potential Vs of electrostatic latent images which change from one original to another, it is possible to achieve a bias potential for the first conductor which is substantially optimum for originals or documents of varying density, by a suitable choice of the parameters R11, R12 and Va without requiring an adjustment of the exposure. It will be also seen that, as compared with the use of the developing electrode of floating potential type, the bias potential applied to the first conductor will be somewhat higher in the lower region of the average potential Vs and will be somewhat lower in the higher region of the average potential Vs, thereby enabling a copy free from background smearing to be obtained from a document having a low proportion of image areas and also permitting photographs of generally lower brightness level to be copied without substantial degradation in the contrast.

Figure 6:
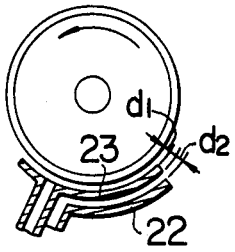
FIG. 6 is a fragmentary schematic view of another embodiment of the invention.
Figure 7:
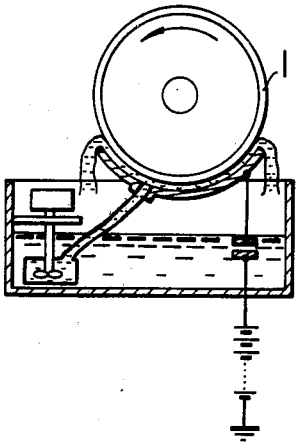
FIGS. 7, 8 and 9 are similar fragmentary views of electrophotographic copying machines which incorporate other embodiments of the invention.

FIG. 6 shows another embodiment in which the relative area of a first conductor 23 and a second conductor 22 has a proportional relationship with the ratio of the distance $d_1$ between the drum surface and the first conductor to the distance $d_2$ between the first and second conductors. For example, when the second conductor 22 has an area which is three fifth the area of the first conductor 23, the spacing $d_2$ is chosen to be equal to three fifth the spacing $d_1$, so that R11 is approximately equal to R12. In this manner, a change in the resistance presented by the developer, which may result from a degradation in the quality of the developer with time or from environmental changes, is cancelled out because of a similar change in both R11 and R12, thus minimizing the net effect of the change of the resistance and permitting a stabilized copy quality to be maintained. FIG. 7 shows a modification of the developing unit shown in FIG. 6. Functionally, the developing unit shown in FIG. 7 is completely similar to that shown in FIG. 6.

Referring to FIG. 4, it will be noted that a switch SW is connected between the resistor R12 and the positive terminal of the potential source Va. The switch SW is a single pole, double throw switch, and, in its other position, the positive terminal of the potential source Va is connected with the resistor R12 through a resistor R13. When the background density of an original is high, the switch SW can be manually thrown to the other position so as to connect the resistors R11, R12 and R13 in series. In this instance, the potential $V_D$ applied to the first conductor will have a relationship relative to the average surface potential Vs as indicated by a phantom line or single dot chain line 24 in FIG. 5, thus producing a relatively reduced potential of the developing electrode for an original of an increased background density and thus assuring a copy of a satisfactory quality.

Figure 8:
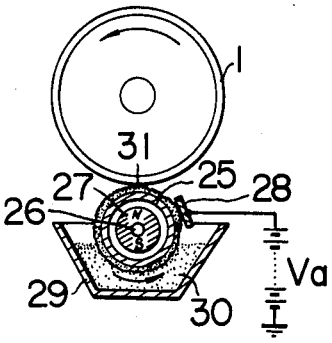

FIG. 8 shows a further embodiment of the invention as applied to the conventional magnetic brush developing process which employs a dry toner. The first conductor, which functions as a developing electrode, is formed by an electrically conductive cylinder 25 which is electrically insulated and which is carried by a shaft 26 for rotation in the direction indicated by an arrow. Inside the conductive cylinder 25, a permanent magnet 27 is disposed on the shaft 26. A given spacing is maintained between the surface of the drum 1 and the conductive cylinder 25, and a doctor blade 28, which functions as the second conductor, is disposed at a given spacing from the surface of the conductive cylinder 25 at a location remote from the drum surface. The doctor blade 28 is connected with the ground through an external constant voltage source Va. It will be appreciated that an arrangement utilizing the corona discharger may be substituted for the external source Va. A mixture 30, contained within a vessel 29, which comprises a toner and a ferromagnetic and electrically conductive carrier is attracted against the surface of the cylinder 25 under the attraction of the magnet 27, thereby forming a brush 31 thereon. During its rotation, the conductive cylinder 25 functions to bring the brush 31 into contact with the latent image carried on the drum surface, thereby developing the latent image with the toner. The doctor blade 28 serves for controlling the length of the magnetic brush as well as the area of contact over which it contacts the drum surface. It also cooperates with the charge of latent image on the drum surface to induce a proper bias potential on the conductive cylinder 25.

The electrical equivalent circuit of this embodiment is similar to that shown in FIG. 4, and various parameters can be properly chosen to induce a bias potential, applied to the magnetic brush, which is adequate to assure a copy image free from background smearing. With a dry developer, the resistance which it presents is particularly susceptible to the influence of the environment, temperature and humidity, but the present embodiment maintains a proper bias, which is effective to minimize the influence of a change in the resistance of the developer and thus to maintain a stabilized image quality of the copy. Where the resistance of the developer is unlikely to change, the resistance presented by the developer between the cylinder 25 and the doctor blade 28 may be replaced by a fixed resistor of a corresponding magnitude, for example, $10^6$ to $10^{21}$ ohms.

Figure 9:
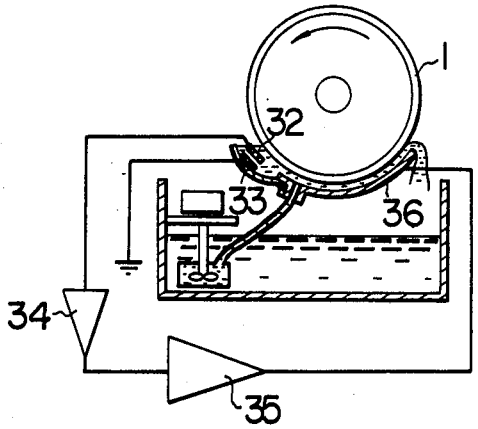

In the above description, the invention has been applied to a developing electrode. However, the invention can equally be applied to a detecting electrode which is used to establish an automatic bias for the developing electrode, as shown in FIG. 9. Specifically, a first conductor 32 and a second conductor 33 are disposed at one end of the developing station, and have equal areas as well as equal spacing between the drum surface and the first conductor and between the first and second conductors. The second conductor is connected with the ground, whereby a potential which is equal to one-half the average surface potential of the electrostatic latent image will be induced on the first conductor. This potential is amplified by a factor of two by an amplifier 34, which feeds an operational amplifier 35. In one example, a plurality of first conductors 32 are provided, and the operational amplifier 35 is arranged so that its output applied to a developing electrode 36 is a minimum potential among the first conductors plus several tens of volts, thus establishing an optimum bias. If a single detecting electrode is employed, a change in the resistance presented by the developer will result in a corresponding change in the detection potential, which precludes a stabilized bias from being applied to the developing electrode over a prolonged period of use. However, with the detecting electrode of the present embodiment, the influence of change in the resistance of the developer upon the detection potential is almost completely eliminated.

What is claimed is:

1. A developing unit for use with electrophotographic copying apparatus comprising photoreceptor means, having a photosensitive surface movable in a direction, for retaining an electrostatic latent image on said surface, developing electrode means maintained close to said latent image carrying surface, and means for supplying a developer between said surface and said electrode means to thereby develop the latent image, said unit comprising;

a. first conductor means maintained spaced apart from said latent image carrying surface by a first predetermined distance, a fraction of said developer used being filled up between said first conductor and said surface, b. second conductor means maintained spaced apart from said first conductor means by a second predetermined distance, a fraction of said developer used being filled up between said first and second conductors, c. means connecting said second conductor means to the ground, and d. means maintaining the potential on said electrode means at a magnitude which is in a predetermined relationship with the magnitude of the potential on said first conductor means caused by an average potential of an electrostatic latent image facing thereto.

2. A unit according to claim 1 wherein said first and second distances are preset such that the resistance of that fraction of said developer which is present between said surface and said first conductor means is equal to the resistance of that fraction of said developer which is present between said first and second conductor means.

3. A unit according to claim 1 wherein said first conductor means is part of said developing electrode means.

4. A unit according to claim 3 wherein said potential maintaining means comprises a constant voltage source means connected between said second conductor means and the ground.

5. A unit according to claim 4 wherein said apparatus comprises a corona discharger, and said voltage source means comprises a conducting plate disposed within said discharger, a varistor connecting said conducting plate to ground, and means connecting the junction between said plate and said varistor to said second conductor means.

6. A unit according to claim 3 further comprising resistor means, and means selectively operable to connect said second conductor means to ground.

7. A unit according to claim 1 wherein said potential maintaining means comprises operational amplifier means connected between said first conductor means and said developing electrode means.

8. A unit according to claim 1 wherein said developer used is of liquid type.

9. A unit according to claim 1 wherein said developer used is of dry type.

* * * * *